US005567189A

United States Patent [19]

Sehl

[11] Patent Number: 5,567,189

[45] Date of Patent: Oct. 22, 1996

[54] SAILBOAT RUDDER-MOTOR PROP GUARD

[76] Inventor: Douglas P. Sehl, 6633 Harbor Dr., Hudson, Fla. 34667

[21] Appl. No.: 526,443

[22] Filed: Sep. 11, 1995

[51] Int. Cl.[6] ..... B63H 5/16

[52] U.S. Cl. ..... 440/71

[58] Field of Search ..... 440/53, 71, 72; 114/39.1

[56] References Cited

U.S. PATENT DOCUMENTS

| | | | |
|---|---|---|---|
| 142,820 | 9/1873 | Stevens et al. | 440/72 |
| 2,054,374 | 9/1936 | Fuller | 440/71 |
| 2,470,874 | 5/1949 | Sidney | 440/71 |
| 4,565,533 | 1/1986 | Springer | 440/71 |
| 5,176,550 | 1/1993 | Hooper | 440/72 |
| 5,205,766 | 4/1993 | Arsenualt | 440/72 |

*Primary Examiner*—Stephen Avila

*Attorney, Agent, or Firm*—John L. Schmitt

[57] ABSTRACT

A guard, particularly adapted to protect a blade of a sailboat rudder from a propeller of an outboard motor mounted on a stern of the boat, includes a mounting plate. The mounting plate has an inner end prepared for ready attachment to a side of a fin of the motor located above the propeller. As attached, the plate then extends laterally toward the rudder to terminate a selective distance beyond outer end tips of blades of the propeller. On an outer end of the mounting plate is a curved protector tube having forward and rear end curved sections which extend respectively toward and away from the boat stern and back toward the motor. During travel of the boat by operation of the motor, the boat is steered by movement of the rudder which selectively positions the rudder blade to effect changes in directions. When rotational movement of the rudder in the direction of the motor is excess, the rudder blade engages the guard protector tube. This engagement stops further rudder movement and thus prevents potentially damaging contact between the rudder blade and the rotating propeller.

9 Claims, 2 Drawing Sheets

SAILBOAT RUDDER-MOTOR PROP GUARD

BACKGROUND OF THE INVENTION

1. Field of the Invention:

This invention relates to guards for outboard motor propellers and more particularly to a guard that prevents contact between a blade of a sailboat rudder and propeller blades of an outboard motor mounted on one side of a stern transom of the sailboat.

2. Prior Art:

Guards to protect blades of a boat outboard motor propeller have been known and in use for a number of years. In most cases such guards shield the propeller from foreign objects and vegetation in water in which the boat is traveling.

One early example of a guard for outboard motors is disclosed in U.S Pat. No. 2,054,374. In this case, the guard comprises a pairs of bars. Attached to each bar is a pair of curved wire prongs. The bars then are bolted to a vertical housing for a propeller shaft of the motor to locate one prong pair on each side and to a rear of the propeller.

Another early propeller guard for outboards motors is set out in U.S. Pat. No. 2,470,874 and includes a collar fitted to the propeller shaft vertical housing of the motor. The collar forms a pivot for a pair of downwardly extending hangers. Lower ends of these hangers curve outward and project rearward on respective sides of the propeller. When not in use, the guard may be swung up and out of the water by releasing the hangers from a clamp attached to the housing below the collar.

U.S. Pat. No. 4,565,533 discloses a more recent boat motor propeller guard having a main rib that fits over a leading edge of the propeller shaft vertical housing of the motor. This rib is secured in part to the housing by a clamping strap connected to a V-shaped bracket on the rib top end. Extending rearward from each side of the main rib is a pair of horizontal, spaced apart side ribs located respectively above and below the propeller. On a bottom end of the main rib is a sleeve that fits over a lower rudder fin of the motor and a set of three shock absorbing ribs that extend below and to a rear of the propeller.

Lastly, a wire, basket-shaped propeller guard is set forth in Finnish Patent No. 25,617. This guard is slidably disposed on a vertical rod allowing the guard to be lowered and then rotated to partially enclose the propeller of a boat fitted with an in-board motor. While not shown, the basket seemingly is formed with a horizontal slot allowing the basket to pass over a shaft of the propeller.

SUMMARY OF THE INVENTION

A guard of this invention is particularly adapted for use with outboard motors mounted on one side of stern transoms of smaller sailboats. The guard includes a mounting plate having an inner end prepared for ready attachment to a horizontal fin of the motor located above a propeller of the motor. Attached to an outer end of the mounting plate is a middle section of a curved protector tube having a forward and a rear end curved section which bend back toward the mounting plate inner end. The forward curved section then connects with a front end straight section. Outer ends of the tube sections are fitted by protective caps.

For use the guard plate is attached to a side of the motor fin so that the plate extends toward a rudder centrally located on the boat stern transom. A length of the guard mounting plate is such that the protector tube locates beyond a vertical plane in alignment with tips of blades of the motor propeller.

As the propeller rotates to drive the boat through water, the boat is steered by manual manipulation of a tiller to which the rudder is attached. To effect a change in course in a counterclockwise direction, e.g., to port or left, the tiller is moved clockwise which in turn swings the rudder and its blade toward the port side of the boat and toward the motor, assuming that the motor is mounted on the port or left side of the transom. If the rudder swing were lengthy, the rudder blade engages the guard protector tube stopping further rudder movement in that direction. Preventing further movement averts contact between the rudder blade and the rotating blades of the propeller.

The guard of this invention provides several advantages over outboard motor guards known or presently in use.

A first advantage is that this inventive guard is specifically designed for use with side mounted outboard motors in wide use on small sailboats. Additionally, because the guard is invertible, one guard is usable regardless on which side of the rudder the motor is mounted. There is no need for left hand and right hand guard models.

Another advantage is that this inventive guard may be readily installed by simply attaching the guard to the horizontal fin or cavitation plate forming part of most all low horsepower outboard motors. Further, no special tools or mounting brackets are required. Note also that this motor fin is located immediately above blades of the motor propeller to regulate blade cavitation. Therefore, the guard is positioned at an ideal depth to prevent propeller-rudder blade contact. Typically, the motor is installed to locate the propeller at about the same in-water depth as the rudder blade.

A still further advantage is that the increased length of the protector tube front end and forward curved sections not only provides an effective stop for the rudder blade but also inhibits foreign matter such as weeds from collecting on the mounting plate. The convex curvature of the tube forms a streamlined guide surface for water and any foreign matter therein to flow pass the guard. This convex shape of the tube also allows maximum rudder movement and resulting steerage before contact.

Lastly, when the motor is pivot mounted on a top edge of the boat stern transom, the guard front end and forward curved sections also prevent rudder blade-operating propeller contact when the propeller end of the motor is swung up toward a surface of the water. Such swinging action can occur if the motor propeller end were to ground or raised intentionally to release weeds entangling the propeller blades.

DESCRIPTION OF THE PREFERRED EMBODIMENT

Figure 1:
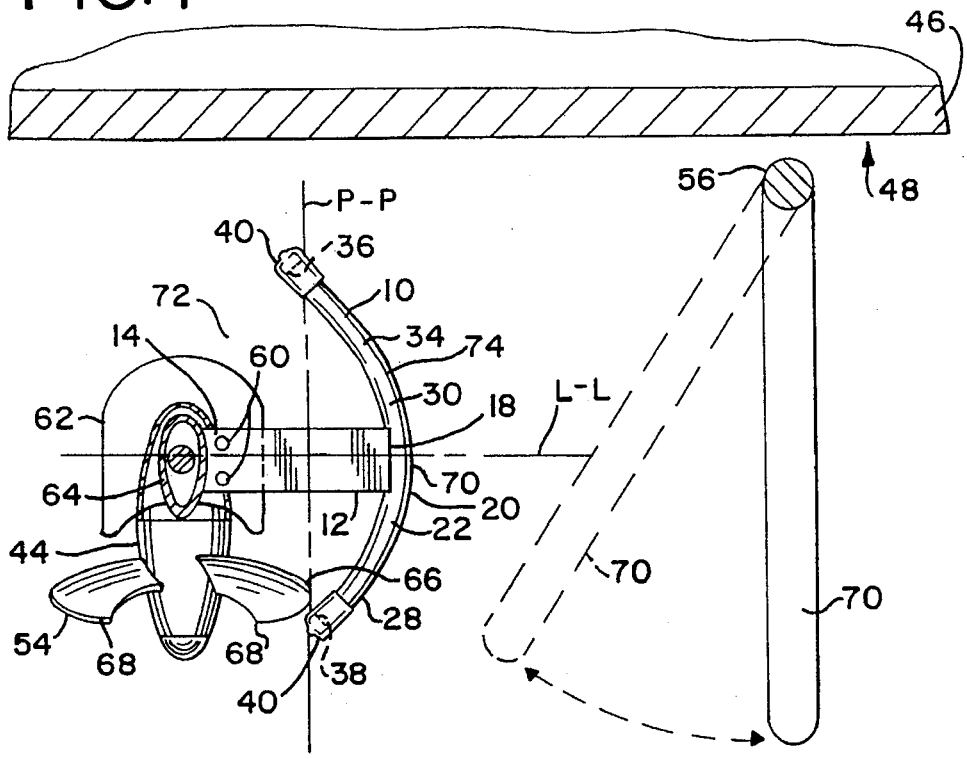
FIG. 1 is a plan view in partial section showing the relationship between a transom of a sailboat stern an outboard motor mounted on that transom, a guard of this invention attached to the motor, and a rudder of the boat.

A guard of this invention is shown generally in FIGS. 1—4 and designated 10. The guard 10 includes a mounting plate 12 having an inner end 14 formed with a pair of spaced apart, transversely positioned openings 16.

Attached to an outer end 18 of the mounting plate 12 is a middle curved section 20 of a protector tube 22. To facilitate attachment by welding a top side 24 of the plate 12 seats against a bottom side 26 of the tube 22, see FIG. 4.

The tube middle section 20 is joined by a rear end curved section 28 and a forward curved section 30. These curved sections 20, 28, and 30 share a common radius and center point 32 in alignment with a longitudinal axis L—L of the mounting plate 12. The center point 32 is located about ¾ in. beyond the mounting plate inner end 14. Joining the forward curved section 30 is a front end straight section 34 which is positioned tangentially to the forward curved section 30.

Because a combined length of the forward curved section 30 and the front end straight section 34 is greater than a length of the rear end curved section 28, an outer end 36 of the straight section 34 does not laterally align with an outer end 38 of rear end curved section 28. The front outer end 36 of the tube 22 lies laterally closer to the plate inner end 14 than the tube rear outer end 38. Both outer ends 36, 38 are covered with plastic caps 40.

Figure 2:
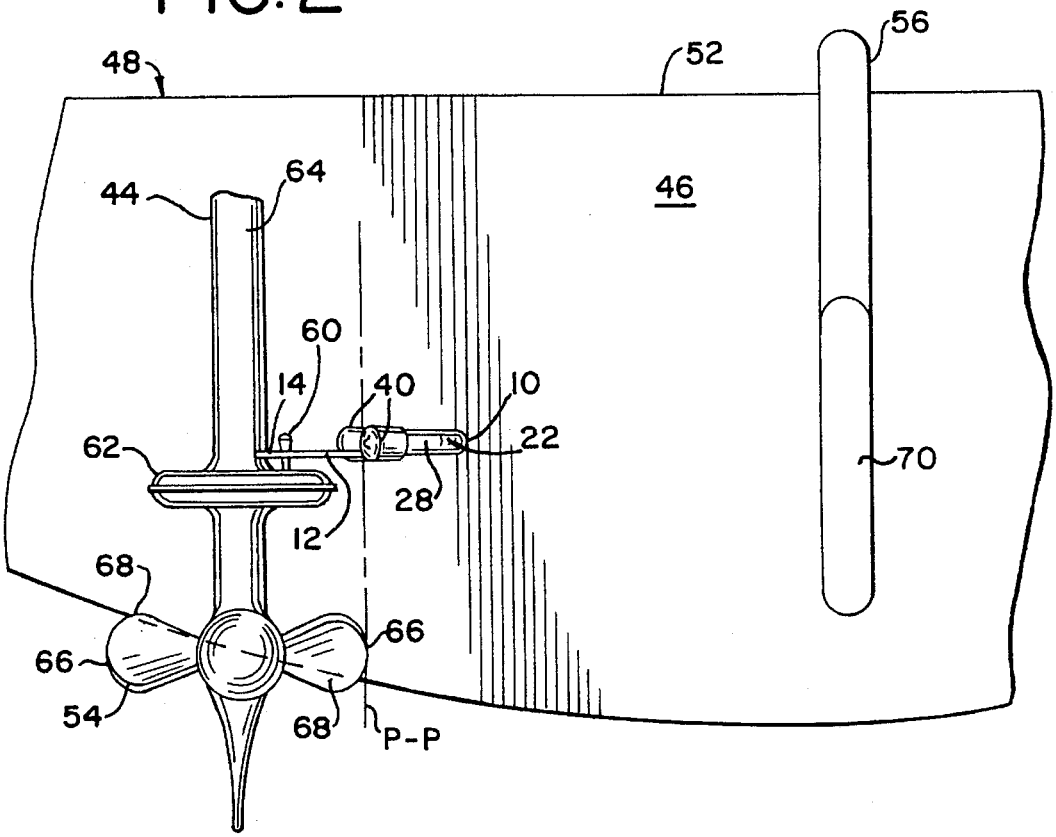
FIG. 2 is an end elevational view of the sailboat of FIG. 1.
Figure 3:
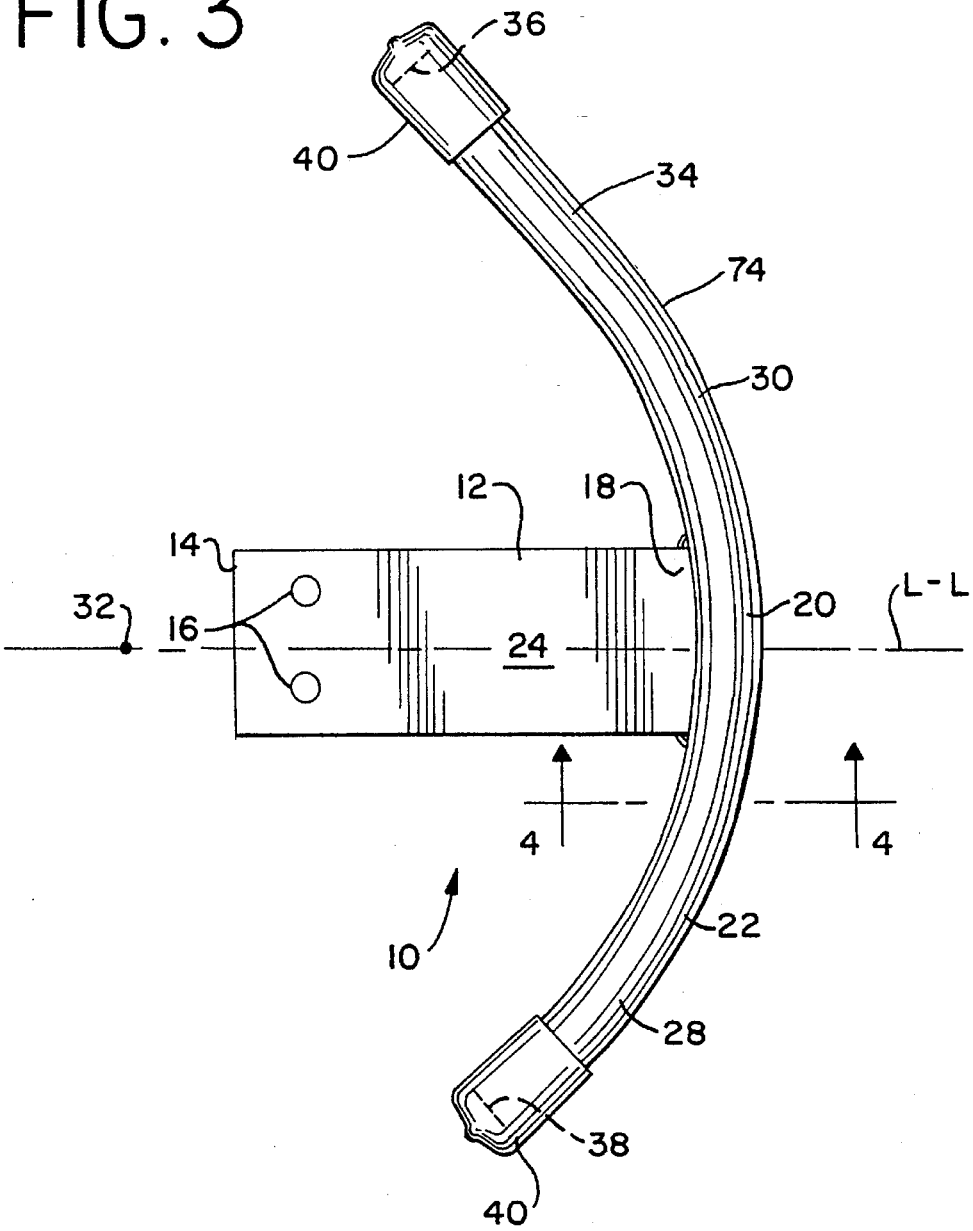
FIG. 3 is a plan view of a guard of the invention.
Figure 4:
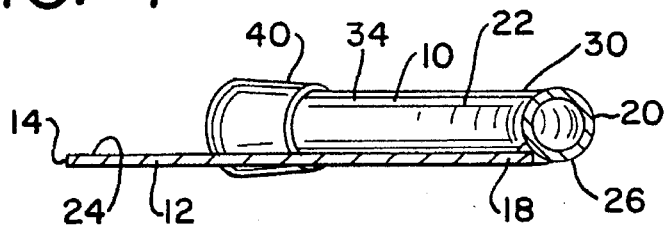
FIG. 4 is a cross sectional view as seen generally along a line 4—4 in FIG. 3.

As seen in FIGS. 1 and 2, for use the guard 10 is attached to an outboard motor 44 stationarily mounted to a stern transom 46 of a sailboat 48. While not shown, in a known manner the motor 44 may either be mounted of a top edge 52 of the transom 46 by a set of inverted C-clamps formed as part of the motor 44 or attached to a spring activated bracket attached to the transom 46. The latter mounting arrangement is more commonly used with somewhat larger sailboats while the former with smaller boats 48. In either case, when the motor 44 is not in use, a propeller 54 of the motor 44 is raised out of the water.

As shown in FIG. 1, the motor 44 is located on the port or left side of a rudder 56 of the boat 48. Alternately, the motor 46 could be mounted on the starboard or right side of the rudder 56. Because the guard 10 is invertible, the guard 10 may be attached to the motor 44 regardless of motor location so that the guard 10 extends laterally toward the rudder 56.

The mounting plate openings 16 are conveniently located for the guard 10 to be attached by screws 60 to a side of an intermediate horizontal fin 62 (also referred to as a cavitation plate) integrally formed as part of a vertical propeller shaft housing 64 of the motor 44. As located, the guard protector tube middle section 20 locates at least one inch beyond a vertical plane P—P positioned perpendicular to and passing through the axis L—L. This plane P—P also intersects respective tips 66 of blades 68 of the propeller 54 as these blade tips 66 rotate to a location opposite the rudder 56.

During movement of the boat 48 with its sails down and the motor 44 operating, directional changes of the boat 48 are effected by movement of a tiller (not shown) which is attached to the rudder 56. Tiller movement changes an angular position of a blade 70 of the rudder 56 so that water flowing pass the rudder blade 70 is deflected producing a force vector that swings the boat stern. Note that this steering is different than typical outboard motor driven boats where the motor is used to effect directional changes. To alter the direction of boat movement in a counterclockwise direction, for example from north to a northeast direction, the tiller and connecting rudder 54 are swung clockwise. If the degree of this swing were excessive to execute an abrupt change in direction for example, the rudder blade 70 engages the rear end curved section 28 of guard protector tube 22. This rudder blade-protector tube engagement stops any further rudder movement which in turn prevents damaging contact between the rudder blade 70 and the rotating propeller blades 68. Thus, the rudder blade 70 and the propeller blades 68 remain damage free.

If clockwise rudder rotation were excessive when a C-clamp mounted motor 44 were momentarily swung from the water to clear its propeller blades 68 of weeds for example, rudder blade-propeller blade contact also is prevented. In this case, rudder movement is stopped by the rudder blade 70 engaging the protector tube front end section 34 and forward curved section 30.

During boat movement by motor power, the protector tube front end straight section 34 also helps reduce collection of weeds or like foreign matter on the mounting plate 12. Note that the lateral distance between the protector tube front outer end 36 and the motor housing 64 is small. Thus, there is only a narrow space 72 for debris to pass and possibly collect on the mounting plate 12. Also, the front end straight section 34 and forward curved section 30 of the protector tube 22 form a guide surface 74 that promotes the flow of water and any debris around the guard 10. Accordingly, the guard 10 not only inhibits damage but remains substantially service-free and adds minimal drag as the sailboat 48 moves under motor power.

While an embodiment, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A guard particularly adapted for use with sailboat side-mounted outboard motors, said guard comprising:

a mounting plate having an inner end prepared for ready attachment to said motor, and a convex-like shaped tube attached to an outer end of said mounting plate to form a protective barrier a selective distance about a side of said motor, said protector tube defined in part by spaced apart forward and rear curved sections connected by a middle curved section with said mounting plate attached to said middle section, wherein for use said guard is attached to said motor to extend toward a rudder of said boat, and then during travel of said boat by operation of said motor said guard tube may intercept movement of a blade of said rudder toward a propeller of said motor to prevent contact between said rudder blade and said motor propeller with said middle and rear curved sections forming a primary area for engagement by said rudder blade when said motor is vertically positioned.

2. A guard as defined by claim 1 and further characterized by, said protector tube having a front outer end spaced laterally closer to said inner end of said mounting plate than a spacing of a rear outer end of said tube, wherein a space between said tube front outer end and said motor is minimized to inhibit collection of foreign matter on said mounting plate during said boat travel.

3. A guard as defined by claim 1 and further characterized by, said tube curved sections sharing a common radius and center point located beyond said mounting plate inner end.

4. A guard as defined by claim 1 and further characterized by, said protector tube including a forward curved section connecting with a front end section positioned substantially tangential to said forward curved section, wherein said front end section and said forward curved section form a primary area for engagement by said rudder blade when said motor is in an angular positioned.

5. A guard as defined by claim 1 and further characterized by, a set of openings formed on said mounting plate inner end, wherein said openings facilitate said attachment of said mounting plate to a horizontal fin of said motor located above said propeller.

6. A guard as defined by claim 1 and further characterized by, said guard protector tube having a front and a rear outer end, and protective caps fitted respectively over said outer ends.

7. A guard particularly adapted for use with sailboat side-mounted outboard motors, said guard comprising:

a mounting plate having an inner end prepared for ready attachment to said motor, and a convex-like shaped tube attached to an outer end of said mounting plate to form a protective barrier a selective distance about a side of said motor, and a top side of said mounting plate outer end being attached to a bottom side of said protector tube, wherein for use said guard may be attached to said motor mounted on a port side of said boat or inverted and attached to said motor mounted on a starboard side of said boat to extend toward a rudder of said boat, and then during travel of said boat by operation of said motor said guard tube may intercept movement of a blade of said rudder toward a propeller of said motor to prevent contact between said rudder blade and said motor propeller.

8. An outboard motor guard particularly adapted to prevent contact between a blade of a rudder of a sailboat and propeller blades of an outboard motor mounted on a stern transom of said boat to one side of said rudder, said guard comprising:

a mounting plate having an inner end attached to a horizontal fin forming part of a vertical propeller shaft housing of said motor so that said mounting plate extends laterally toward said rudder, and a convex-like shaped protector tube having a middle curved section joined to an outer end of said mounting plate to locate said protector tube a selective distance laterally beyond said propeller blades, a rear and a forward curved section spaced apart and joined to said middle curved section, and a front end straight section joined to said forward curved section to locate an outer end of said front end straight section laterally closer to said mounting plate inner end than an outer end of said rear curved section, wherein during travel of said boat by operation of said motor, said protector tube forms a stop to inhibit rudder blade-propeller blade contact caused by movement of said rudder blade toward said motor during an abrupt or major change in direction of said boat with said protector tube middle and rear curved sections forming a primary area for engagement by said rudder blade.

9. An outboard motor guard as defined by claim 8 and further characterized by, said protector tube front end section and said forward curved section forming a guide surface, wherein water and foreign matter in said water may flow smoothly pass said guard during movement of said boat in said water.

* * * * *